US010434431B2

(12) United States Patent
Chen

(10) Patent No.: US 10,434,431 B2
(45) Date of Patent: Oct. 8, 2019

(54) TOY BUILDING SYSTEM AND PERIPHERAL ASSEMBLAGE THEREOF

(71) Applicant: KINPO ELECTRONICS, INC., New Taipei (TW)

(72) Inventor: Ting-Shuo Chen, New Taipei (TW)

(73) Assignee: KINPO ELECTRONICS, INC., New Taipei (TW)

( * ) Notice: Subject to any disclaimer, the term of this patent is extended or adjusted under 35 U.S.C. 154(b) by 21 days.

(21) Appl. No.: 15/871,000

(22) Filed: Jan. 14, 2018

(65) Prior Publication Data

US 2019/0217216 A1 Jul. 18, 2019

(51) Int. Cl.

*A63H 33/04* (2006.01)
*A63H 33/10* (2006.01)
*A63H 30/04* (2006.01)

(52) U.S. Cl.

CPC ..... *A63H 33/042* (2013.01); *A63H 30/04* (2013.01); *A63H 33/103* (2013.01); *A63H 2200/00* (2013.01)

(58) Field of Classification Search

CPC .... A63H 33/042; A63H 30/04; A63H 33/103; A63H 2200/00

See application file for complete search history.

(56) References Cited

U.S. PATENT DOCUMENTS

2002/0196250 A1* 12/2002 Anderson ..... G06T 19/00 345/420
2017/0144083 A1* 5/2017 K rsgaard ..... A63H 33/042
2017/0263155 A1* 9/2017 Broms ..... A63H 33/086
2017/0333803 A1* 11/2017 Brandwijk ..... A63H 33/042

* cited by examiner

*Primary Examiner* — Jeffrey S Vanderveen
(74) *Attorney, Agent, or Firm* — Chun-Ming Shih; HDL IPR Services

(57) ABSTRACT

A toy building system and a peripheral assemblage thereof are disclosed. The peripheral assemblage includes a plug-in apparatus and a function apparatus. The plug-in apparatus includes a battery module, a wireless transmission module, and a plug-in connection module. The function apparatus includes a function module, a wired transmission module, a function connection module, and a control module. The function apparatus is connected to another assemblage in a wired manner through the wired transmission module to form a data connection and a power connection. The function apparatus is detachably connected to the plug-in apparatus to form the power connection to the battery module and forms a data connection to another assemblage through the wireless transmission module. Accordingly, the function apparatus is immediately upgraded to a wireless function apparatus, thereby increasing the flexibility of use and enhancing the experience of use.

20 Claims, 7 Drawing Sheets

TOY BUILDING SYSTEM AND PERIPHERAL ASSEMBLAGE THEREOF

BACKGROUND OF THE INVENTION

Technical Field

The technical field relates to a system and an assemblage thereof, and more particularly to a toy building system and a peripheral assemblage thereof.

Description of Related Art

In the prior art, there is currently a toy building system that has been proposed. The toy building system includes assemblages with different functions, such as a sensor, a motor driver, a buzzer, or so on. The user can combine the assemblages with different functions like blocks to create a dedicated electronic apparatus.

For example, the user can combine an assemblage, such as a human sensor with another assemblage, such as a buzzer to create an automatic alarm. Accordingly, when the human sensor detects that a personnel invasion occurs, the human sensor may transmit a data signal to control the buzzer alarming.

Please refer to FIG. 1A, which shows an architecture diagram of a conventional toy building system. As shown in FIG. 1A, the toy building system 10 includes a tablet computer 100 and a plurality of wireless sensors 102-108, wherein a battery and a Bluetooth transmitter are built in each of the wireless sensors 102-108. The built-in battery supplies the required power to the corresponding wireless sensor 102-108 so that each wireless sensor 102-108 senses ambient conditions, produces an ambient datum, and transmits the ambient datum in a wireless manner to the tablet computer 100 for analyzing and controlling by the tablet computer 100.

Please refer to FIG. 1B, which shows another architecture diagram of the conventional toy building system. As shown in FIG. 1B, the toy building system 12 includes a control host 120 and a plurality of wired sensors 122-128, wherein a cable receptacle is built in each of the wired sensors 122-128. After the wired sensors 122-128 are connected to the control host 120 through cable wires, the control host 120 supplies the required power to the wired sensors 122-128 through the cable wires. Also, each wired sensor 122-128 could transmit the ambient datum sensed by each wired sensor 122-128 to the control host 120 for analyzing and controlling by the control host 120.

However, the drawback of the prior art toy building system is that one assemblage can be connected to another assemblage only in a wired manner or a wireless manner, that is, the assemblage fails to connect to other assemblages in both wired manner and wireless manner, thereby lacking the flexibility of use and the experience of use.

SUMMARY OF THE INVENTION

The present disclosure is directed to a toy building system and a peripheral assemblage thereof to upgrade the peripheral assemblage to a wireless peripheral assemblage by a plug-in manner.

In one embodiment, a peripheral assemblage is applied to a toy building system. The peripheral assemblage includes a plug-in apparatus and a function apparatus. The plug-in apparatus includes a battery module, a wireless transmission module, and a plug-in connection module. The wireless transmission module is connected to another assemblage of the toy building system in a wireless manner. The plug-in connection module is electrically connected to the battery module and the wireless transmission module. The function apparatus includes a function module, a wired transmission module, a function connection module, and a control module. The function module produces data or operates according to received data. The wired transmission module is connected to the another assemblage in a wired manner. The function connection module is detachably connected to the plug-in connection module. The control module is electrically connected to the function module, the wired transmission module, and the function connection module, and the control module transmits and receives data via a data connection. When the wired transmission module is connected to the another assemblage in the wired manner, the control module forms the data connection and a power connection to the another assemblage through the wired transmission module; when the function connection module is detachably connected to the plug-in connection module, the control module forms the data connection to the another assemblage through the wireless transmission module and forms the power connection to the battery module.

In one embodiment, a toy building system includes at least one peripheral assemblage and a core assemblage. The core assemblage is connected to the at least one peripheral assemblage, and the core assemblage controls the at least one peripheral assemblage.

In one embodiment, a peripheral assemblage is applied to a toy building system. The peripheral assemblage comprises a plug-in apparatus and a function apparatus. The plug-in apparatus comprises a wired transmission module and a plug-in connection module. The wired transmission module is connected to another assemblage of the toy building system in a wired manner. The plug-in connection module is electrically connected to the wired transmission module. The function apparatus comprises a function module, a battery module, a wireless transmission module, a function connection module and a control module. The function module is configured to produce data or operate according to received data. The wireless transmission module is connected to the another assemblage in a wireless manner. The function connection module is detachably connected to the plug-in connection module. The control module is electrically connected to the function module, the battery module, the wireless transmission module, and the function connection module, and the control module is configured to transmit and receive data via a data connection. The control module forms the data connection to the another assemblage through the wireless transmission module, and forms a power connection to the battery module; when the function connection module is detachably connected to the plug-in connection module and the wired transmission module is connected to the another assemblage in the wired manner, the control module forms the data connection and the power connection to the another assemblage through the wired transmission module.

Accordingly, the function apparatus can be immediately upgraded to a wireless function apparatus, thereby increasing the flexibility of use and enhancing the experience of use.

It is to be understood that both the foregoing general description and the following detailed description are exemplary, and are intended to provide further explanation of the present disclosure as claimed. Other advantages and features of the present disclosure will be apparent from the following description, drawings and claims.

BRIEF DESCRIPTION OF DRAWING

The present disclosure can be more fully understood by reading the following detailed description of the embodiment, with reference made to the accompanying drawings as follows.

DETAILED DESCRIPTION

Figure 1B:
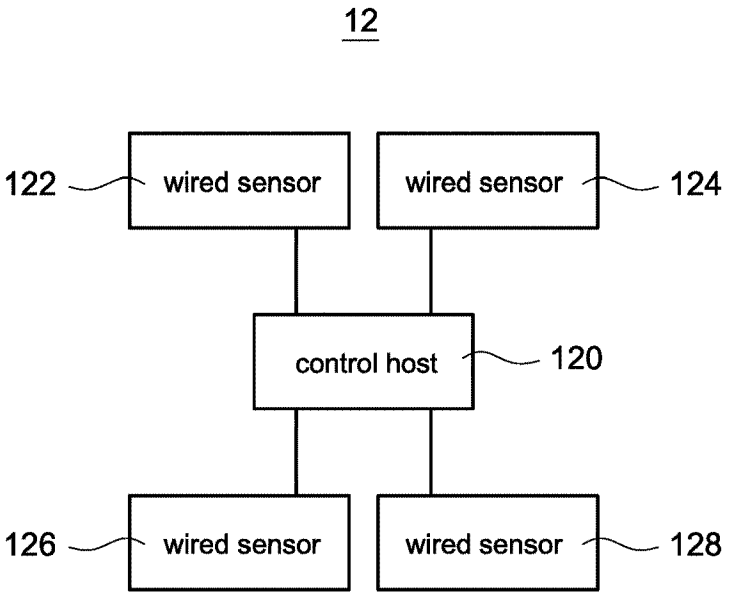
FIG.1B (Related Art)
FIG. 1B is another architecture diagram of the conventional toy building system.
Figure 1A:
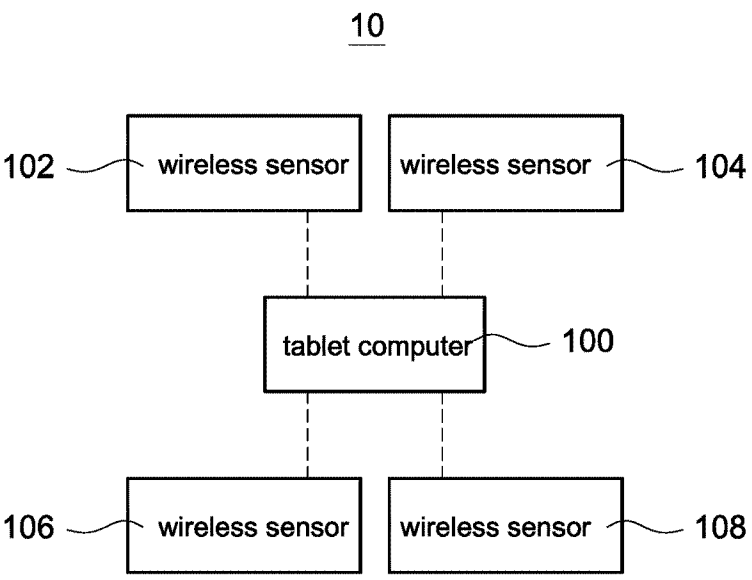
FIG.1A (Related Art)
FIG. 1A is an architecture diagram of a conventional toy building system.

Reference will now be made to the drawing figures to describe the present disclosure in detail. It will be understood that the drawing figures and exemplified embodiments of present disclosure are not limited to the details thereof.

Figure 2:
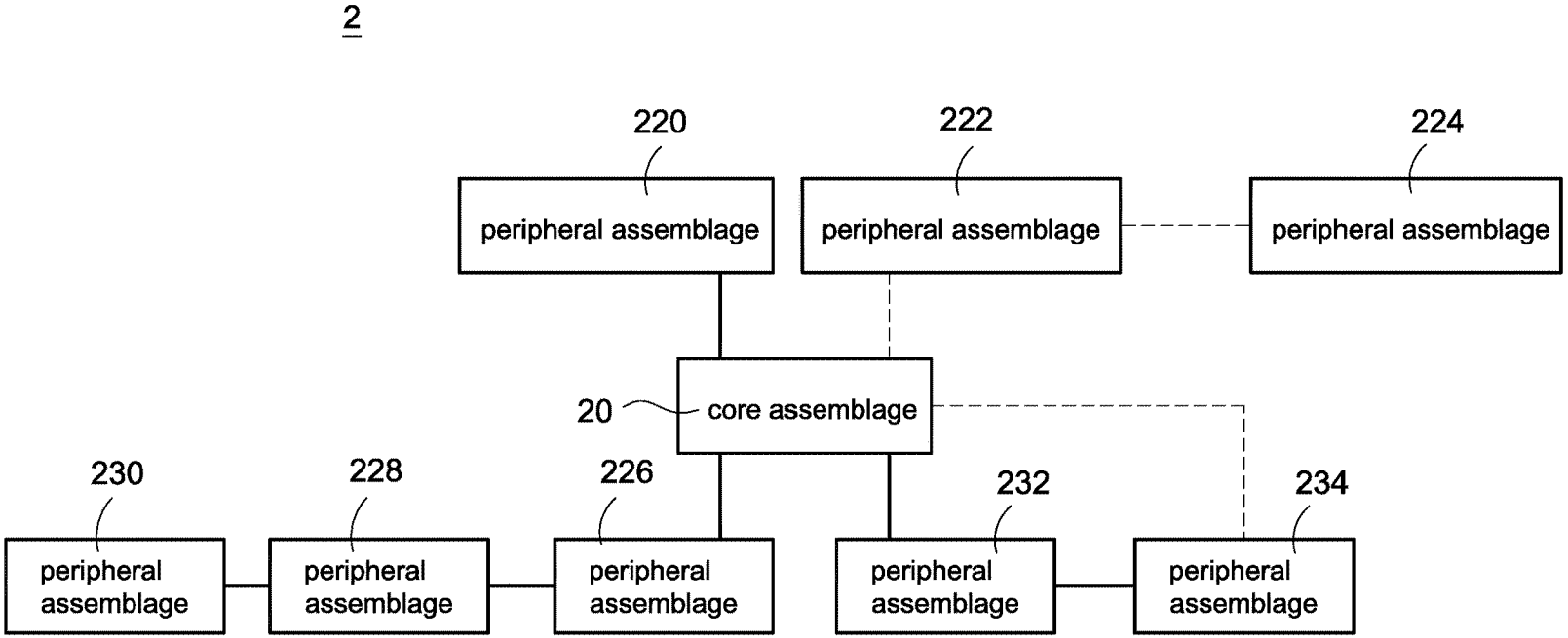
FIG. 2 is an architecture diagram of a toy building system according to one embodiment of the present disclosure.
Figure 3A:
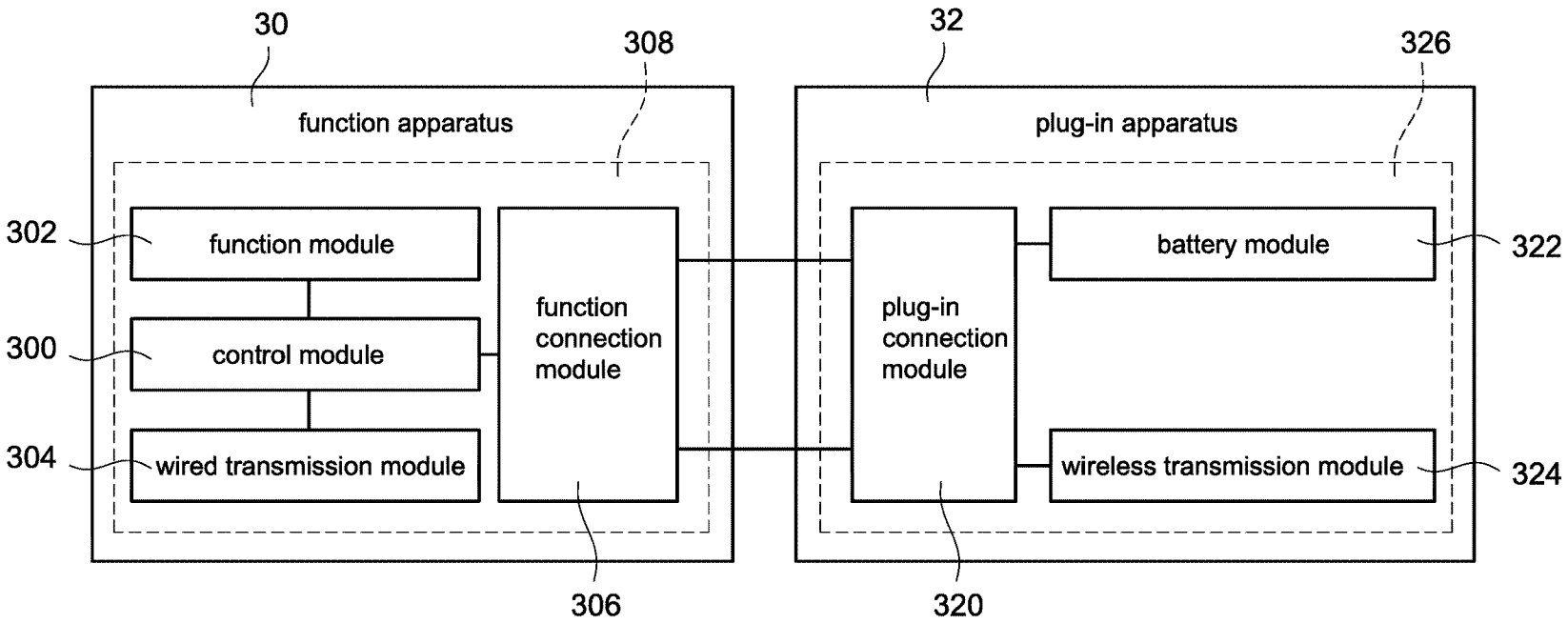
FIG. 3A is an architecture diagram of a peripheral assemblage according to one embodiment of the present disclosure.
Figure 4:
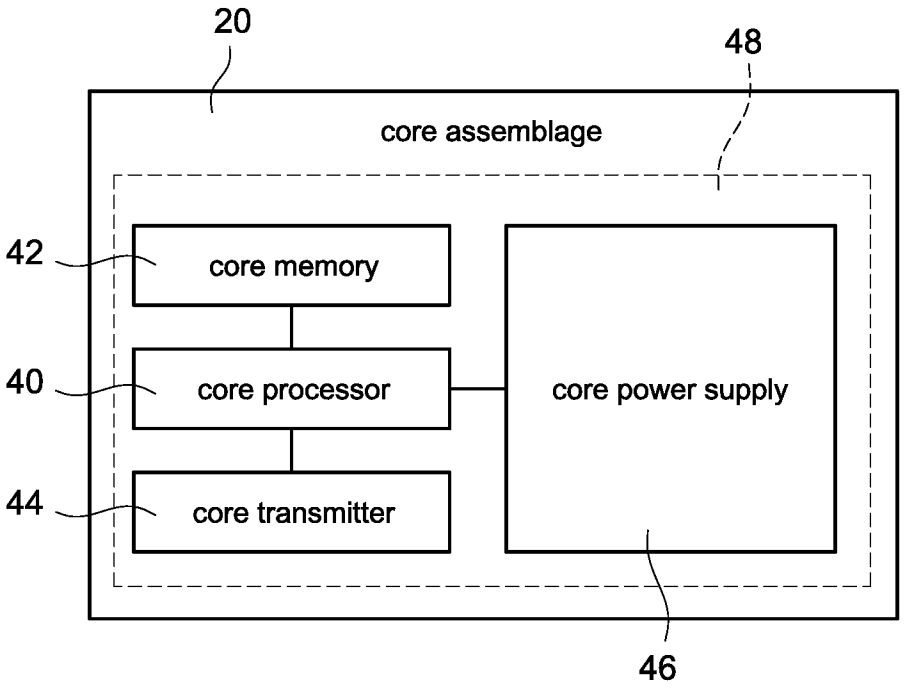
FIG. 4 is an architecture diagram of a core assemblage according to one embodiment of the present disclosure.

Please refer to FIG. 2, FIG. 3A, and FIG. 4, which show an architecture diagram of a toy building system, an architecture diagram of a peripheral assemblage, and an architecture diagram of a core assemblage according to one embodiment of the present disclosure, respectively. As shown in FIG. 2, the user can combine the assemblages with different functions of the toy building system 2 to create a dedicated electronic apparatus.

In one embodiment, the toy building system 2 includes a core assemblage 20 and a plurality of peripheral assemblages, such as eight peripheral assemblages 220-234 shown in FIG. 2. Each peripheral assemblage 220-234 may be directly or indirectly connected to the core assemblage 20.

Please refer to FIG. 3A, each peripheral assemblage 220-234 includes a function apparatus 30 and a plug-in apparatus 32. In this embodiment, the function apparatus 30 has a capability of a wired connection, and the function apparatus 30 could be connected to the core assemblage 20 and/or other peripheral assemblages 220-234 in a wired manner. Also, the function apparatus 30 could acquire the required power and the capability of a wireless connection through the plug-in apparatus 32.

The function apparatus 30 includes a function module 302, a wired transmission module 304, a function connection module 306, and a control module 300 electrically connected to the function module 302, the wired transmission module 304, and the function connection module 306. In one embodiment, the function module 302, the wired transmission module 304, the function connection module 306, and the control module 300 may be mounted on the same circuit board 308.

The plug-in apparatus 32 includes a plug-in connection module 320, a battery module 322, and a wireless transmission module 324. The plug-in connection module 320 is electrically connected to the battery module 322 and the wireless transmission module 324. In one embodiment, the plug-in connection module 320, the battery module 322, and the wireless transmission module 324 may be mounted on the same circuit board 326.

The function module 302 of the function apparatus 30 is used to produce data or operate to implement specific function according to received data.

In one embodiment, the function module 302 is a sensor module, such as a photo sensor, an infrared sensor, a color sensor, a temperature sensor, a humidity sensor, an ultrasonic distance sensor, a sound recognizer, a gyro, and/or a track following sensor for providing a sensing function, namely the function apparatus 30 is a sensing apparatus. For example, the function module 302 senses ambient conditions and producing ambient data, namely sensing data produced from the function module 302, namely the sensor module are transmitted to the control module 300.

In one embodiment, the function module 302 is a driver module, such as a motor driver, a gear set, and/or a pump for providing a drive function according to driving data, such as drive commands transmitted from the control module 300, namely the function apparatus 30 is a drive apparatus. For example, the function module 302 drives the toy building system 2 moving in a specific direction.

In one embodiment, the function module 302 is an input module, such as a joystick, button, knob, a microphone, and/or a camera for providing an input function, namely the function apparatus 30 is an input apparatus. For example, the function module 302 receives the user's input, produces input data, and transmits the input data to the control module 300.

In one embodiment, the function module 302 is an output module, such as an LCD screen, an LED display, a text display, an indicating lamp, a speaker, a vibration motor, and/or a buzzer for providing an output function, namely the function apparatus 30 is an output apparatus. For example, the function module 302 outputs output data received from the control module 300.

In one embodiment, the function module 302 is a memory module, such as a flash memory, a memory card, and/or a disk drive for providing a storage function, namely the control module 300 is a storage apparatus. For example, the function module 302 stores storage data received from the control module 300, and reads and transmits the stored storage data to the control module 300 when the control module 300 receives the read commands.

The wired transmission module 304 is connected to another assemblage, such as the core assemblage 20 or another peripheral assemblage in a wired manner. As exemplified in FIG. 2 or FIG. 4, a wired transmission module 304 of the peripheral assemblage 226 is connected to a core transmitter 44, which supports a wired transmission, of the core assemblage 20 through a cable wire, or the wired transmission module 304 is connected to a wired transmission module 304 of another peripheral assemblage 228 through a cable wire.

In one embodiment, the electric cable has at least four wires, wherein at least two of the at least four wires are provided for data connection, and at least two of the at least four wires are provided for power connection.

In one embodiment, the wired transmission module 304 and the core transmitter 44 are USB modules, power over Ethernet (PoE) modules, or other wired transmission interfaces, which can simultaneously transmit data signals and power.

In one embodiment, the wired transmission module 304 is a detachable connection module, such as a USB receptacle or a RJ-45 receptacle, and the wired transmission module 304 could be connected to another assemblage through a cable wire, such as USB cable wire or Ethernet cable wire having a detachable plug, such as a USB plug or a RJ-45 plug.

In one embodiment, the wired transmission module 304 and the transmission module, such as the core transmitter 44 or a wired transmission module 304 of another peripheral assemblage may be a Pogo pin and a Pogo pin contact, respectively, to be easily detachable and assembled.

In one embodiment, the wired transmission module 304 and the core transmitter 44 are the same specification of the transmission module, or different specifications but compatible with each other. For example, the core transmitter 44 may be a wired transmission interface of USB 3.0 Type-C, and the wired transmission module 304 may be a wired transmission interface of USB 2.0, USB 3.0 Type-A, USB 3.0 Type-C, or Thunderbolt 3.

The function connection module 306 is detachably connected to the plug-in connection module 320 of the plug-in apparatus 32.

In one embodiment, the detachable connection between the function connection module 306 and the plug-in connection module 320 has at least four wires, wherein at least two of the at least four wires are provided for data connection, and at least two of the at least four wires are provided for power connection.

In one embodiment, the function connection module 306 and the plug-in connection module 320 may be a Pogo pin and a Pogo pin contact, respectively, to be easily detachable and assembled without using cable wires.

In one embodiment, the function connection module 306 and the plug-in connection module 320 may be other type of connection modules, such as a USB module or an Ethernet power module, and the function connection module 306 and the plug-in connection module 320 are connected to each other through corresponding cable wires.

The control module 300, such as a microcontroller unit (MCU) is used to control components of the function apparatus 30. More specifically, the control module 300 may receive data from other assemblages, such as the core assemblage 20 or other peripheral assemblages, or transmit data to other assemblages via the data connection. Moreover, the control module 300 may acquires the required power for the function apparatus 30 via the power connection.

For example, if the function module 302 is the sensor module, the control module 300 transmits the sensing data produced from the function module 302 to another assemblage via the data connection. If the function module 302 is the driver module, the control module 300 receives the driving data from another assemblage and transmits the received driver data to the function module 302 via the data connection. If the function module 302 is the input module, the control module 300 transmits the input data produced from the function module 302 to another assemblage via the data connection. If the function module 302 is the output module, the control module 300 receives output data from another assemblage and transmits the received output data to the function module 302 via the data connection. If the function module 302 is the memory module, the control module 300 receives storage data from another assemblage and stores the received storage data in the function module 302 via the data connection. Alternatively, the control module 300 receives read commands from another assemblage and transmits the received read commands to the function module 302 so that the function module 302 reads the corresponding storage data and transmits the read storage data to another assemblage via the data connection.

The plug-in connection module 320 of the plug-in apparatus 32 is detachably connected to the function connection module 306 of the function apparatus 30. The plug-in connection module 320 and the battery module 322 form a power connection, and the plug-in connection module 320 and the wireless transmission module 324 form a data connection.

The battery module 322 is used to store electricity power. The wireless transmission module 324 is connected to another assemblage, such as the core assemblage 20 or another peripheral assemblage in a wireless manner, and therefore to form the data connection. For example, after the peripheral assemblage 222 is mounted on the plug-in apparatus 32, the wireless transmission module 324 of the plug-in apparatus 32 is connected to the core transmitter 44, which supports a wired transmission, of the core assemblage 20 in the wireless manner, or the wireless transmission module 324 is connected to a wireless transmission module 324 of another peripheral assemblage 224.

In one embodiment, the wireless transmission module 324 and the core transmitter 44 are Wi-Fi wireless transmission modules, ZigBee wireless transmission modules, Bluetooth wireless transmission modules, or other wireless transmission interfaces, which can transmit data signals in a wireless manner.

When the wired transmission module 304 of the function apparatus 30 is connected to another assemblage, such as the core assemblage 20 or another peripheral assemblage in a wired manner, the control module 300 of the function apparatus 30 can simultaneously form a wired data connection and a power connection to another assemblage through the wired transmission module 304, and therefore the control module 300 can transmit data with the another assemblage and acquire the required power for the function apparatus 30.

When the plug-in apparatus 32 is connected to the function apparatus 30, i.e., the plug-in connection module 320 is detachably connected to the function connection module 306, the control module 300 of the function apparatus 30 forms a wireless data connection to another assemblage through the wireless transmission module 324 of the plug-in apparatus 32, and therefore the control module 300 can transmit data with the another assemblage. Also, the control module 300 of the function apparatus 30 further forms a power connection to the battery module 322 of the plug-in apparatus 32, and therefore the control module 300 can acquire the required power for the function apparatus 30 from the battery module 322.

When the plug-in apparatus 32 is detachably connected to the function apparatus 30, the function apparatus 30 is immediately upgraded to a wireless function apparatus, also referred to as "function apparatus with a wireless connection function", thereby increasing the flexibility of use and enhancing the experience of use. In particular, the function apparatus 30 can normally operate through external power acquired from the plug-in apparatus 32 instead of built-in power source of the function apparatus 30.

In one embodiment, each peripheral assemblage 220-234 further provides a charging function. More specifically, when the plug-in apparatus 32 is connected to the function apparatus 30, i.e., the plug-in connection module 320 is detachably connected to the function connection module 306, and the wired transmission module 304 of the function apparatus 30 is connected to another assemblage in a wired manner, the battery module 322 of the plug-in apparatus 32 forms a power connection to the another assemblage in a wired connection through the plug-in connection module 320, the function connection module 306, the control module 300, and the wired transmission module 304, and therefore the battery module 322 can be charged via the power connection.

At this condition, the function apparatus 30 forms a data connection to the another assemblage through the wired transmission module 304, or the function apparatus 30 forms a data connection to the another assemblage through the wireless transmission module 324.

In particular, the function apparatus 30 may also acquire the required power and the capability of a wireless connection through the plug-in apparatus 32 although the wired transmission module 304 is included in the function apparatus 30, and the battery module 322 and the wireless transmission module 324 are included in the plug-in apparatus 32.

Figure 3B:
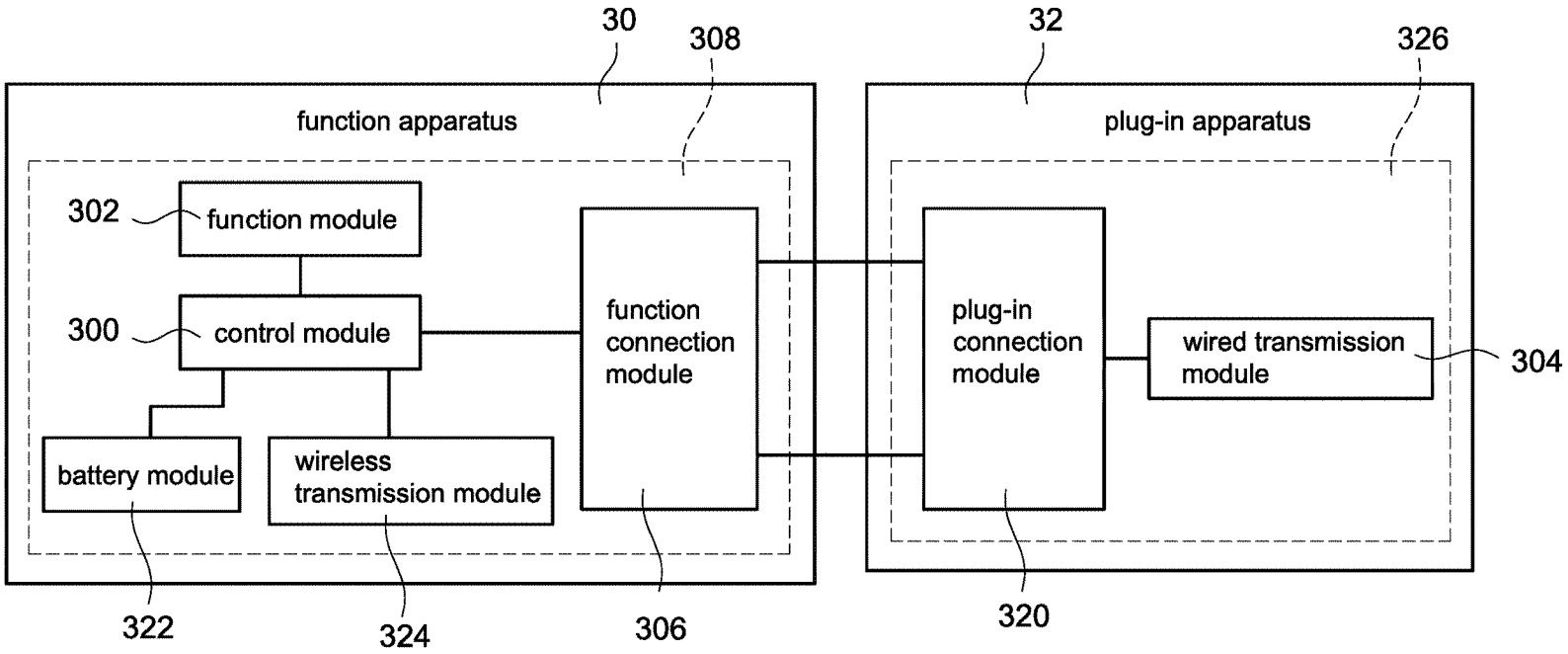
FIG. 3B is another architecture diagram of the peripheral assemblage according to another embodiment of the present disclosure.

Please refer to FIG. 3B, which shows another architecture diagram of the peripheral assemblage according to another embodiment of the present disclosure. As exemplified in FIG. 3B, the battery module 322 and the wireless transmission module 324 are included in the function apparatus 30, and the wired transmission module 304 is included in the plug-in apparatus 32. In other words, the function apparatus 30 has own battery power and the capability of a wired connection. Alternatively, the function apparatus 30 further has the capability of a wired connection through the plug-in apparatus 32. When the plug-in apparatus 32 is detachably connected to the function apparatus 30, and the plug-in apparatus 32 is connected to the core transmitter 44 of the core assemblage 20 through the wired transmission module 304 and the cable wire, the function apparatus 30 and the core assemblage 20 form a power connection, and therefore the battery module 322 of the function apparatus 30 can be charged via the power connection.

In one embodiment, the control module 300, the function module 302, the battery module 322, the wireless transmission module 324, and the function connection module 306 may be integrated and mounted on the same circuit board 308; the plug-in connection module 320 and the wired transmission module 304 may be integrated and mounted on another the same circuit board 326.

In one embodiment, when the wired transmission module 304 is connected to another assemblage in a wired manner, and the function connection module 306 is detachably connected to the plug-in connection module 320, the battery module 322 forms a power connection to the another assemblage through the wired transmission module 304, and therefore the battery module 322 of the function apparatus 30 can be charged via the power connection.

In one embodiment, the wireless transmission module 324 and the wired transmission module 304 are simultaneously connected to another assemblage, and the function connection module 306 is detachably connected to the plug-in connection module 320, the control module 300 forms a power connection to the another assemblage through the plug-in connection module 320, and also forms a data connection to the another assemblage through the wireless transmission module 324.

As shown in FIG. 4, the core assemblage 20 includes a core memory 42, a core transmitter 44, a core power supply 46, and a core processor 40 electrically connected to the core memory 42, the core transmitter 44, and the core power supply 46.

In one embodiment, the core processor 40, the core memory 42, the core transmitter 44, and the core power supply 46 may be integrated and mounted on the same circuit board 48.

The core transmitter 44 is used to connect to the peripheral assemblages 220-234. In one embodiment, the core transmitter 44 may be a wired transmitter, a wireless transmitter, or a wired/wireless integrated transmitter. The core transmitter 44 forms data connections and/or power connections to the peripheral assemblages 220-234 through various wired transmission interfaces and/or wireless transmission interfaces.

The core memory 42 is used to store data. The core power supply 46, such as a battery or a power supply connected to a supply mains is used to supply electricity power. The core processor 40 is used to control the core assemblage 20.

In one embodiment, the core memory 42 stores a plurality of control rules. The core processor 40 processes the data received from any one of the peripheral assemblages 220-234, produces the corresponding control commands according to the control rules stored in the core memory 42, and transmits the control commands to the corresponding peripheral assemblages 220-234.

For example, it is assumed that the peripheral assemblage 220 is a human sensor, the peripheral assemblage 222 is an LED lamp, and the peripheral assemblage 224 is a camera. Also, the control rule is "to active the LED lamp and the camera when a person is detected by the human sensor". According to the control rule, therefore, the core assemblage 20 is programmed into "the peripheral assemblage 220 respectively transmits a light-on command and a video-on command to the peripheral assemblage 222 and the peripheral assemblage 224 when the peripheral assemblage 220 receives a trigger signal provided from the person", and therefore the toy building system 2 turns on the LED lamp and actives a video function of the camera.

In one embodiment, it is assumed that the peripheral assemblage 220 is a color sensor and the peripheral assemblage 222 is a motor and gear driver. Also, the control rule is "to drive the toy building system 2 moving in a black path". According to the control rule, therefore, the core assemblage 20 is programmed into "the peripheral assemblage 220 analyzes received color data, and the peripheral assemblage 220 transmits a drive command to the peripheral assemblage 222 when the color data contain black information", and therefore the toy building system 2 is driven to move in a black path.

Next, how the present disclosure forms data connections and power connections between multiple assemblages. As shown in FIG. 2, the core assemblage 20 can directly or indirectly form wired data connections or wireless data connections to the peripheral assemblages 220-234.

Take the direct creation of the data connection for example, the peripheral assemblages 220,226,232 are directly connected to the core assemblage 20 in a wired manner through cable wires shown by solid lines in FIG. 2, thereby directly creating the wired data connections and the wired power connections. After the peripheral assemblage 222 is connected to the plug-in apparatus 32, the peripheral assemblage 222 can form a data connection to the core assemblage 20 through the wireless transmission module 324 shown by a dotted line. Also, the function apparatus 30 of the peripheral assemblage 222 forms a power connection to a battery module 322 of the plug-in apparatus 32 detachably connected to the function apparatus 30.

Take the indirect creation of the data connection for example, after the peripheral assemblage 224 is connected to the plug-in apparatus 32, the peripheral assemblage 224 can form a wireless data connection to the peripheral assemblage 222, and also the peripheral assemblage 224 can form a wireless data connection to the core assemblage 20 through the peripheral assemblage 222.

In one embodiment, the peripheral assemblage 228 is connected to the peripheral assemblage 226 through a cable wire, and also the peripheral assemblage 228 can simultaneously form a wired data connection and a power connection to the core assemblage 20 through the peripheral assemblage 226. Moreover, the peripheral assemblage 230 is connected to the peripheral assemblage 228 through a cable wire, and also the peripheral assemblage 230 can simultaneously form a wired data connection and a power connection to the core assemblage 20 through the peripheral assemblage 228 and the peripheral assemblage 226.

In one embodiment, the peripheral assemblage 234 is connected to the peripheral assemblage 232 through a cable wire. The difference is that the peripheral assemblage 234 is detachably connected to the plug-in apparatus 32 to form a wired power connection to the core assemblage 20 through the peripheral assemblage 232 and form a wireless data connection to the core assemblage 20 through the peripheral assemblage 234.

Accordingly, it would be realized that regardless of between the peripheral assemblages 220-234 or between the peripheral assemblages 220-234 and the core assemblage 20, the wired data connection and the wireless data connection can be flexibly selected to achieve the data transmission. Further, the wired power connection can be used to achieve the power transmission.

Figure 5A:
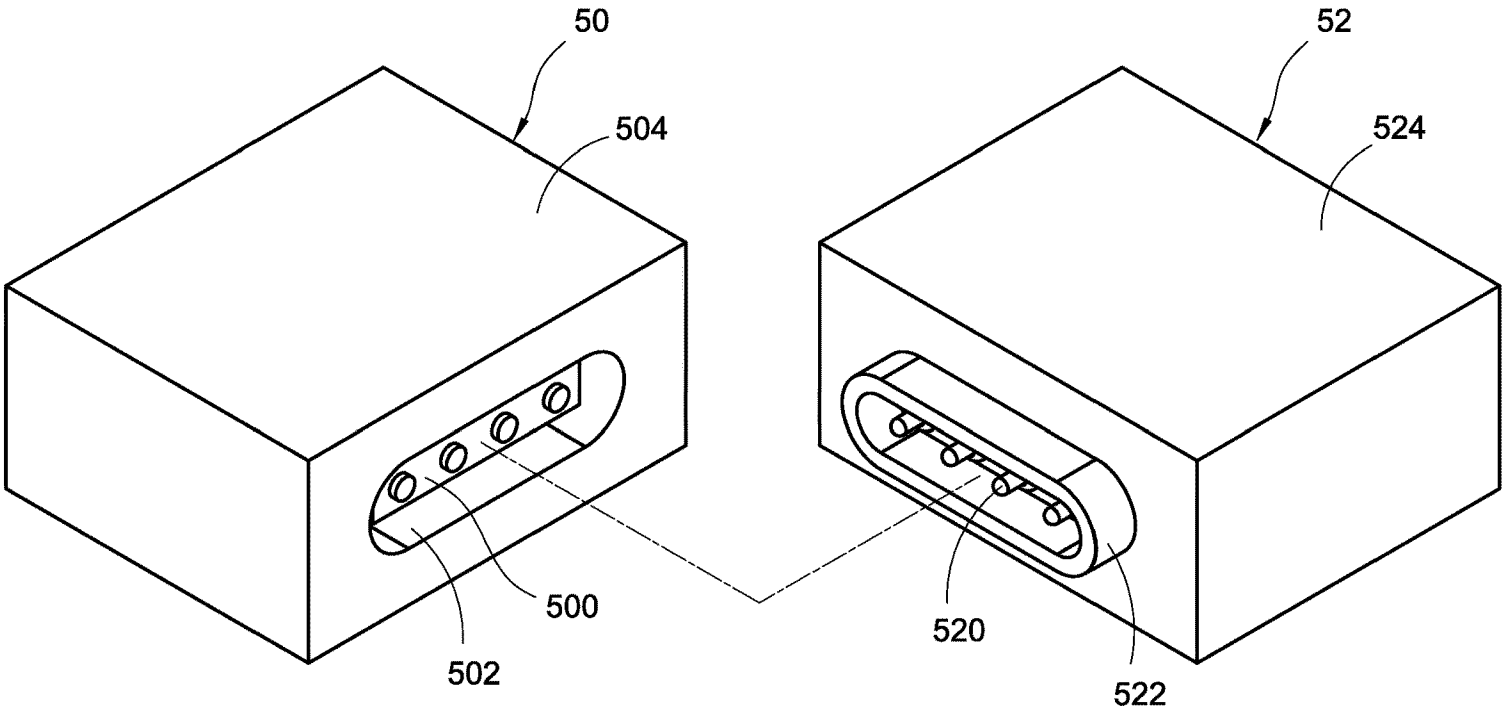
FIG. 5A is a schematic perspective view of a connection between a function apparatus and a plug-in apparatus according to one embodiment of the present disclosure.
Figure 5B:
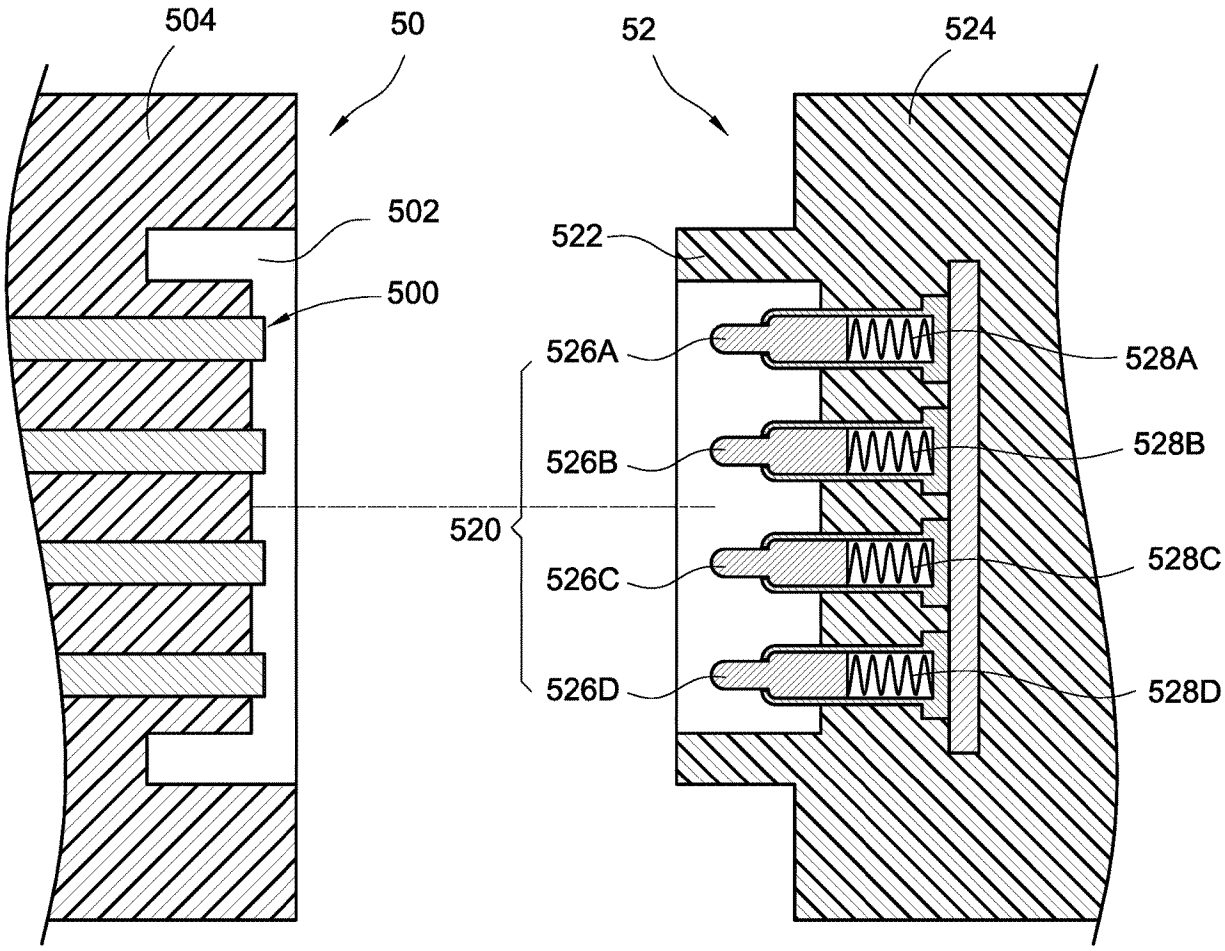
FIG. 5B is a cross-sectional view of the connection between the function apparatus and the plug-in apparatus according to one embodiment of the present disclosure.

Please refer to FIG. 5A and FIG. 5B, which show a schematic perspective view and a cross-sectional view of a connection between a function apparatus and a plug-in apparatus according to one embodiment of the present disclosure, respectively.

As exemplified in FIG. 5A and FIG. 5B, a function apparatus 50, a function connection module 500, a plug-in apparatus 52, and a plug-in connection module 520 are correspondingly the same or similar to the function apparatus 30, the function connection module 306, the plug-in apparatus 32, and the plug-in connection module 320 shown in FIG. 3A, respectively. The same will not be repeated, but only described for differences between the two embodiments as follows.

As exemplified in FIG. 5A, the function apparatus 50 further includes a function housing 504 for protecting the function apparatus 50. More specifically, the function housing 504 covers all modules of the function apparatus 50, such as a function module, a wired transmission module, a function connection module, and a control module.

Moreover, the function housing 504 forms a concave structure 502 on one side thereof, and the function connection module 500 is disposed in the concave structure 502. As exemplified in FIG. 5B, the function connection module 500 is a Pogo pin contact assembly having four Pogo pin contacts, wherein two contacts are used for data transmission and the other two contacts are used for power transmission.

The plug-in apparatus 52 further includes a plug-in housing 524 for protecting the plug-in apparatus 52. More specifically, the plug-in housing 524 covers all modules of the plug-in apparatus 52, such as a battery module, a wireless transmission module, and a plug-in connection module.

Moreover, the plug-in housing 524 forms a convex structure 522, which is correspondingly coordinated with the concave structure 502 on the function housing 504, and the plug-in connection module 520 is disposed in the convex structure 522.

As exemplified in FIG. 5B, the plug-in connection module 520 is a Pogo pin assembly having four Pogo pins 526A-526D, wherein two pins 526A-526B are used for data transmission and the other two pins 526C-526D are used for power transmission.

Moreover, each of the pins 526A-526D has a spring 528A-528D. When thimble portions of the pins 526A-526D of the plug-in apparatus 52 press on the function connection module 500 of the function apparatus 50 and then the springs 528A-528D are compressed to make a length of each spring 528A-528D change, and therefore a position of each pin 526A-526D of the plug-in apparatus 52 changes to make the pins 526A-526D firmly contact to the corresponding contacts of the function connection module 500, thereby forming a conduction between the function connection module 500 and the plug-in connection module 520.

The Pogo pin contact assembly and the Pogo pin assembly are easily detachable and assembled for the function apparatus and the plug-in apparatus, and significantly simplify assembly procedures.

Although the function connection module 500 is the Pogo pin contact assembly and the plug-in connection module 520 is a Pogo pin assembly in the forgoing embodiment, the function connection module 500 may be the Pogo pin assembly and the plug-in connection module 520 may be the Pogo pin contact assembly in another embodiment.

Although the present disclosure has been described with reference to the preferred embodiment thereof, it will be understood that the present disclosure is not limited to the details thereof. Various substitutions and modifications have been suggested in the foregoing description, and others will occur to those of ordinary skill in the art. Therefore, all such substitutions and modifications are intended to be embraced within the scope of the present disclosure as defined in the appended claims.

What is claimed is:

1. A peripheral assemblage applied to a toy building system, the peripheral assemblage comprising:

a wired function apparatus; and a wireless plug-in apparatus for adding the capability of wireless connection to the wired function apparatus;

wherein the wireless plug-in apparatus comprises:

a battery module;

a wireless transmission module configured to be controlled by the wired function apparatus to connect to another assemblage of the toy building system in a wireless manner;

a plug-in connection module electrically connected to the battery module and the wireless transmission module, the plug-in connection module detachably connect in a tangible way to the wired function apparatus;

wherein the wired function apparatus comprise:

a function module configured to produce data or operate according to received data;

a wired transmission module connected to the another assemblage of the toy building system in a wired manner;

a function connection module for plug-in detachably connected in the tangible way to the plug-in connection module of the wireless plug-in apparatus; and a control module electrically connected to the function module, the wired transmission module, and the function connection module, the control module being configured to transmit and receive data via a data connection;

wherein when the wired transmission module of the wired function apparatus is connected to the another assemblage in the wired manner, the control module of the wired function apparatus forms the data connection and a power connection to the another assemblage through the wired transmission module;

wherein when the function connection module of the wired function apparatus is detachably connected in the tangible way to the plug-in connection module of the wireless plug-in apparatus, the wired function apparatus is upgraded to be with the capability of wireless connection, the control module of the wired function apparatus forms the data connection to the another assemblage through the wireless transmission module of the wireless plug-in apparatus and forms the power connection to the battery module of the wireless plug-in apparatus.

2. The peripheral assemblage in claim 1, wherein the function module is a sensor module to produce sensing data, and the control module transmits the sensing data to the another assemblage via the data connection.

3. The peripheral assemblage in claim 1, wherein the function module is a driver module to operate according to driving data, and the control module receives the driving data from the another assemblage via the data connection.

4. The peripheral assemblage in claim 1, wherein the function module is an input module to produce input data according to an external operation, and the control module transmits the input data to the another assemblage via the data connection.

5. The peripheral assemblage in claim 1, wherein the function module is an output module to provide output data, and the control module receives the output data from the another assemblage via the data connection.

6. The peripheral assemblage in claim 1, wherein the plug-in connection module is a Pogo pin or the function connection module is a Pogo pin.

7. The peripheral assemblage in claim 1, wherein the wired transmission module is a detachable connection module to detachably connect to the another assemblage through a cable wire having a detachable plug.

8. The peripheral assemblage in claim 1, wherein the wireless transmission module is a Wi-Fi wireless transmission module, a ZigBee wireless transmission module, or a Bluetooth wireless transmission module.

9. The peripheral assemblage in claim 1, wherein when the wired transmission module is connected to the another assemblage in the wired manner, and the function connection module is detachably connected to the plug-in connection module, the battery module forms the power connection to the another assemblage through the wired transmission module to be charged via the power connection.

10. The peripheral assemblage in claim 1, wherein when the wired transmission module and the wireless transmission module are connected to another assemblage, and the function connection module is detachably connected to the plug-in connection module, the control module forms the power connection to the another assemblage through the wired transmission module and the control module forms the data connection to the another assemblage through the wireless transmission module.

11. The peripheral assemblage in claim 1, wherein the control module is a microcontroller unit, and the control module, the function module, the wired transmission module, and the function connection module are integrated and mounted on the same circuit board.

12. The peripheral assemblage in claim 1, wherein the wired function apparatus comprises a function housing, the function housing is configured to cover the function module, the wired transmission module, the function connection module, and the control module; the wireless plug-in apparatus comprises a plug-in housing, the plug-in housing is configured to cover the battery module, the wireless transmission module, and the plug-in connection module.

13. The peripheral assemblage in claim 1, wherein the wireless transmission module and the wired transmission module are configured to connect to another peripheral assemblage of the toy building system or a core assemblage.

14. A toy building system comprising:

at least one peripheral assemblage in claim 1, and a core assemblage connected to the at least one peripheral assemblage, the core assemblage being configured to control the at least one peripheral assemblage.

15. The toy building system in claim 14, wherein the at least one peripheral assemblage comprises a plurality of peripheral assemblages having various functions; the core assemblage comprises:

a core transmitter configured to connect to the peripheral assemblages;

a core memory configured to store a plurality of control rules;

a core power supply configured to supply electricity power; and a core processor electrically connected to the core transmitter, the core memory, and the core power supply, and the core processor configured to process data received from any one of the peripheral assemblages, produce a control command according to the control rules, and transmit the control command to the corresponding peripheral assemblage.

16. A peripheral assemblage applied to a toy building system, the peripheral assemblage comprising:

a wireless function apparatus; and a wired plug-in apparatus for adding the capability of wired connection to the wireless function apparatus;

wherein the wired plug-in apparatus comprises:

a wired transmission module configured to be controlled by the wireless function apparatus to connect to another assemblage of the toy building system in a wired manner;

a plug-in connection module electrically connected to the wired transmission module, the plug-in connection module detachably connect in a tangible way to the wireless function apparatus;

wherein the wireless function apparatus comprise:

a function module configured to produce data or operate according to received data;

a battery module;

a wireless transmission module connected to the another assemblage of the toy building system in a wireless manner;

a function connection module for plug-in detachably connected in the tangible way to the plug-in connection module of the wired plug-in apparatus; and a control module electrically connected to the function module, the battery module, the wireless transmission module, and the function connection module, the control module being configured to transmit and receive data via a data connection;

wherein the control module of the wireless function apparatus forms the data connection to the another assemblage through the wireless transmission module of the wireless function apparatus, and forms a power connection to the battery module of the wireless function apparatus;

wherein when the function connection module of the wireless function apparatus is detachably in the tangible way connected to the plug-in connection module of the wired plug-in apparatus and the wired transmission module of the wireless function apparatus is connected to the another assemblage in the wired manner, the wireless function apparatus is upgraded to be with the capability of wired connection, the control module of the wireless function apparatus forms the data connection and the power connection to the another assemblage through the wired transmission module of the wired plug-in apparatus.

17. The peripheral assemblage in claim 16, wherein the function module is a sensor module to produce sensing data, a driver module to operate according to driving data, an input module to produce input data according to an external operation, or an output module to provide output data; the control module transmits the sensing data to the another assemblage via the data connection, the control module receives the driving data from the another assemblage via the data connection, the control module transmits the input data to the another assemblage via the data connection, or the control module receives the output data from the another assemblage via the data connection.

18. The peripheral assemblage in claim 16, wherein the wired plug-in connection module is a Pogo pin or the function connection module is a Pogo pin; the control module is a microcontroller unit, and the control module, the function module, the battery module, the wireless transmission module, and the function connection module are integrated and mounted on the same circuit board; the wireless transmission module and the wired transmission module are configured to connect to another peripheral assemblage of the toy building system or a core assemblage.

19. The peripheral assemblage in claim 16, wherein when the wired transmission module is connected to the another assemblage in the wired manner, and the function connection module is detachably connected to the plug-in connection module, the battery module forms the power connection to the another assemblage through the wired transmission module to be charged via the power connection.

20. The peripheral assemblage in claim 16, wherein when the wired transmission module and the wireless transmission module are connected to the another assemblage, and the function connection module is detachably connected to the plug-in connection module, the control module forms the power connection to the another assemblage through the wired transmission module and the control module forms the data connection to the another assemblage through the wireless transmission module.

* * * * *